United States Patent [19]

Bangs et al.

[11] Patent Number: 4,806,948

[45] Date of Patent: Feb. 21, 1989

[54] RIBBON SEPARATING MECHANISM FOR THERMAL PRINTER

[75] Inventors: Richard G. Bangs, Ithaca, N.Y.; Michael O. Grey, Winter Springs, Fla.; Sik-Piu Kwan, Ithaca, N.Y.

[73] Assignee: NCR Corporation, Dayton, Ohio

[21] Appl. No.: 15,657

[22] Filed: Feb. 17, 1987

[51] Int. Cl.[4] ..... E01D 15/10

[52] U.S. Cl. ..... 346/76 PH; 271/18; 346/146; 400/719

[58] Field of Search ..... 400/120 PH, 248, 719, 400/644; 271/18, 225; 346/76 PH, 76 R, 11, 146; 219/216 PH

[56] References Cited

U.S. PATENT DOCUMENTS

| | | | |
|---|---|---|---|
| 4,396,308 | 8/1983 | Applegate et al. | 400/120 |
| 4,458,253 | 7/1984 | Goff, Jr. et al. | 346/76 PH |
| 4,509,060 | 4/1985 | Uozumi | 346/76 PH |
| 4,614,949 | 9/1986 | Hakkaku et al. . | |

FOREIGN PATENT DOCUMENTS

| | | | |
|---|---|---|---|
| 0159676 | 10/1985 | European Pat. Off. . | |
| 0095582 | 7/1980 | Japan | 400/120 |
| 0093373 | 5/1984 | Japan | 400/120 |
| 715718 | 9/1954 | United Kingdom . | |

OTHER PUBLICATIONS

U.S. Application Ser. No. 561,449, filed Dec. 14, 1983.

*Primary Examiner*—E. A. Goldberg
*Assistant Examiner*—Huan H. Tran
*Attorney, Agent, or Firm*—Wilbert Hawk, Jr.; Albert L. Sessler, Jr.; George J. Muckenthaler

[57] ABSTRACT

Apparatus for separating a thermal transfer ribbon from a recording medium includes an elongated member which is positioned adjacent the ribbon and is movable to a position in contact with the ribbon for stripping the ribbon from the recording medium after a printing operation. The elongated member may take the shape and form of a blade or the member may be a wire for stripping the ribbon from the medium.

25 Claims, 11 Drawing Sheets

FIG. 1
PRIOR ART
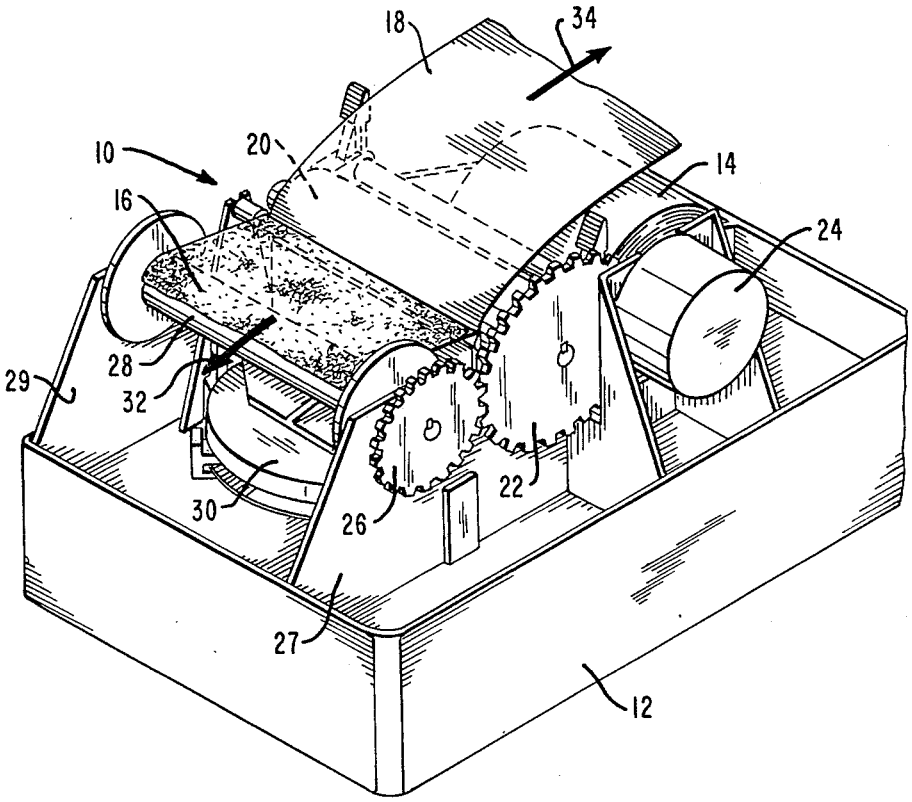
PRIOR ART
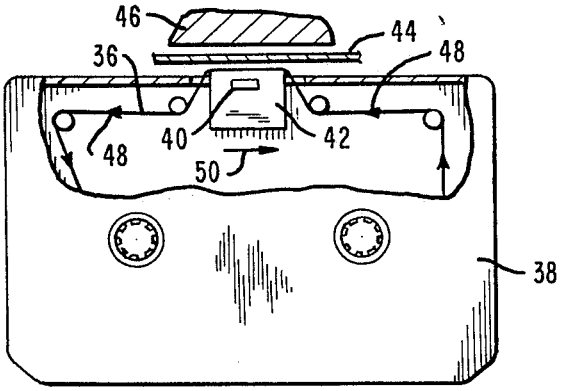
FIG. 2

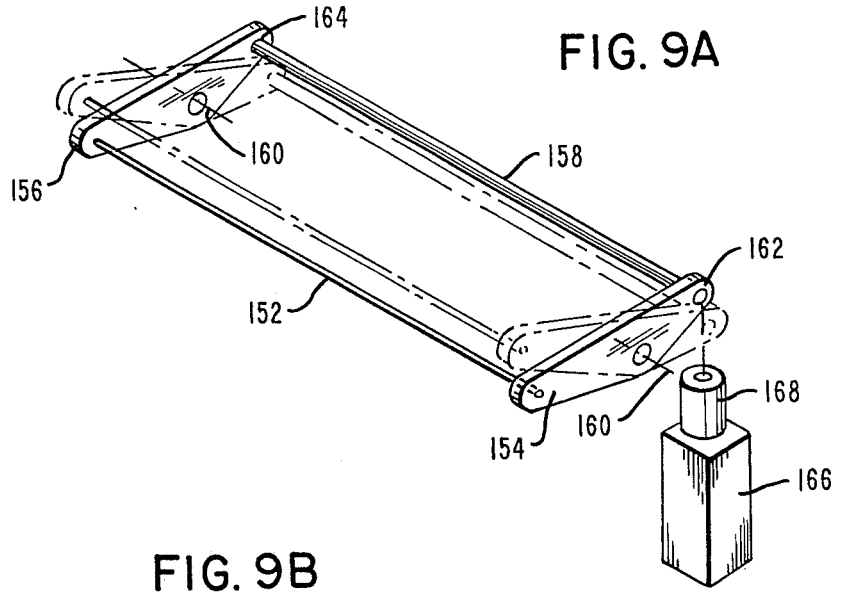
FIG. 9A
FIG. 9B
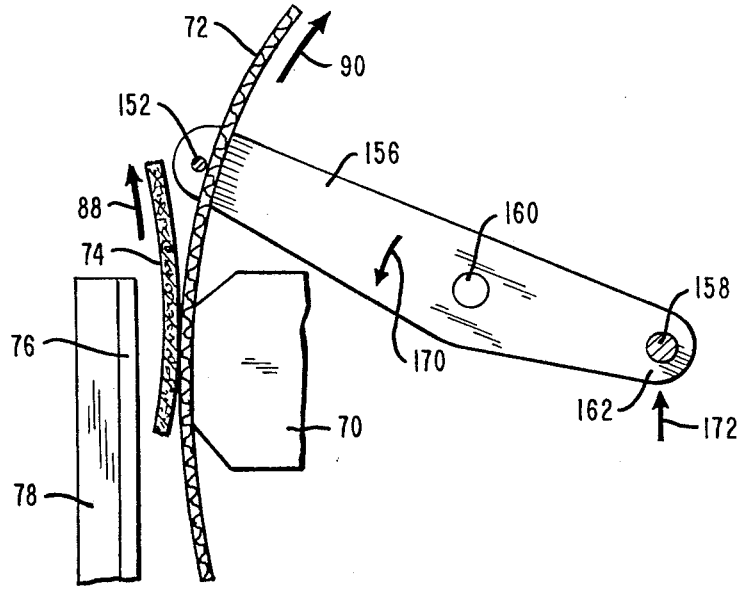

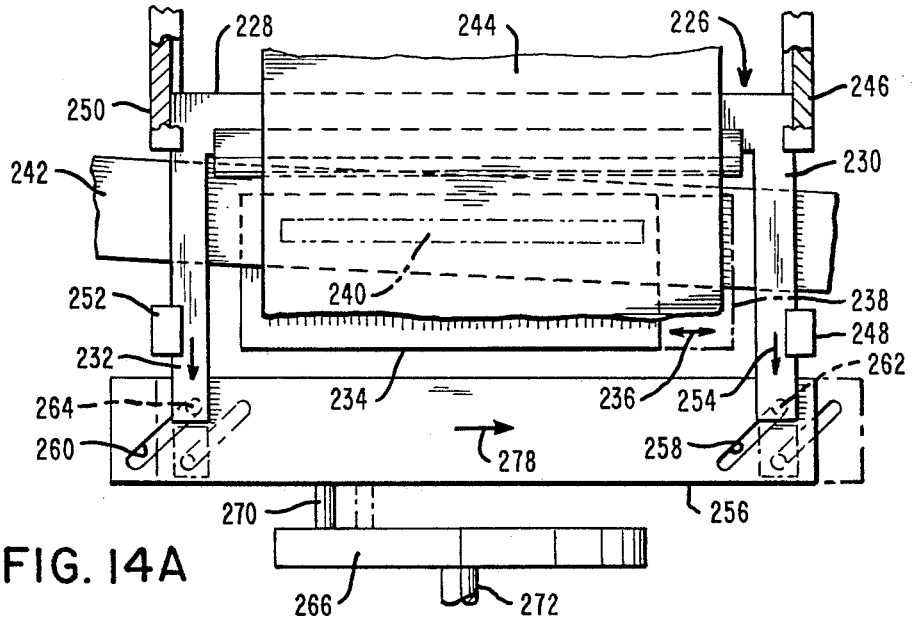
FIG. 14A
FIG. 14B
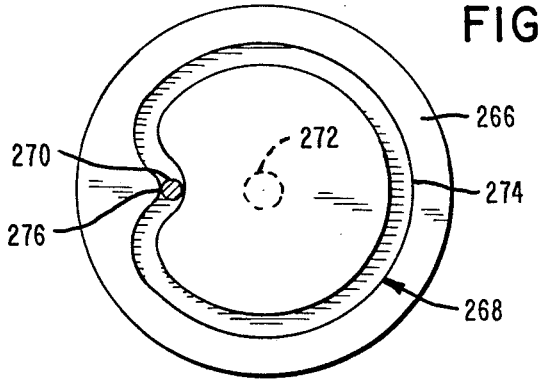
FIG. 14C
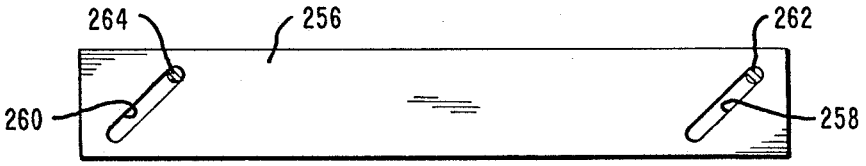

RIBBON SEPARATING MECHANISM FOR THERMAL PRINTER

BACKGROUND OF THE INVENTION

In the field of thermal printers, a print head having a plurality of printing elements is positioned adjacent paper or like record media and the printing elements are heated to an elevated temperature sufficient for effecting printing of characters on the paper. Printing is effected by transferring material in the form of ink from a thermal transfer ribbon, upon heating of the printing elements, onto the paper. The heating of the printing elements which are in contact with the thermal transfer ribbon during the actual printing operation cause the ribbon to be partially fused or bonded with the paper and to interfere with the freedom of advancement of the paper and the ribbon in a subsequent printing operation. It is therefore necessary to separate or strip the ribbon from the paper after each printing operation in one or another direction.

While there have been various ribbon separating mechanisms or systems for effecting separation of the ribbon from the paper, it is advantageous to provide a mechanism or apparatus for operating in compact areas, for operating at the higher printing speeds, and for accomplishing the separation in assured manner.

Representative documentation in the area of thermal printing apparatus includes U.S. Pat. No. 4,396,308, issued to S. L. Applegate et al. on Aug. 2, 1983, which discloses ribbon guiding for thermal lift-off correction wherein the guide is positionable toward the platen on a pivoted arm to allow a bond for correction to set before the ribbon is pulled away.

U.S. Pat. No. 4,458,253, issued to W. Goff et al. on July 3, 1984, discloses thermal print apparatus wherein the ribbon support is movable relative to the paper by an eccentric to move the ribbon into and out of contact with the paper.

U.S. Pat. No. 4,509,060, issued to O. Uozumi on Apr. 2, 1985, discloses a sheet separation system for thermal transfer recording apparatus which includes a separator member that pierces the ink sheet downwardly to push the underlying recording sheet away from the ink sheet.

SUMMARY OF THE INVENTION

The present invention relates to thermal printers. More particularly, the present invention relates to printers which utilize a thermal transfer ribbon for effecting printing on record media by transfer of thermal material initiated from heating of printing elements on the thermal print head.

In printing operation, it is desired and generally required that the thermal transfer ribbon be separated or stripped from the paper or like record media after printing a line of dots or characters. Since the thermal printing elements are heated to an elevated temperature to assure transfer of material from the ribbon onto the paper, the ribbon may, in effect, be bonded to the papers and be moved therewith in preparation for the next line of printing.

In the case of a thermal transfer printer which utilizes a thermal print head having a plurality of printing elements disposed in both horizontal and vertical directions on the print head substrate, stripping or separating the ribbon from the paper is possible only after printing one complete line of characters, rather than after each dot row, or after printing several characters. In the case of a thermal printer which utilizes a print head having a plurality of printing elements disposed in a vertical or aligned direction on the print head substrate, stripping of the ribbon from the paper is possible only after printing a complete line of characters due mainly to the closeness of the printed dots making up the character.

The print head is shuttled or moved in transverse direction with each set of vertical elements printing an integral number of characters to complete the print line. In the case of a print head having five banks or sets of print elements, each bank or set prints eight characters for a total of up to 40 characters along a print line. After printing of a line of characters is completed, the ribbon must be stripped from the paper prior to printing the next line. It is noted that the ribbon is oriented in a generally horizontal direction while the paper is oriented and displaced in a vertical direction.

Stripping or separating the thermal transfer ribbon from the paper may be accomplished by different arrangements and means. A stripper blade may be mounted to one of several parts of the printer and then actuated to be interposed between the ribbon and paper after printing. Another arrangement uses a wire which is mounted to the printer and is interposed between the ribbon and paper. The blade may be of stainless steel material and include a beveled edge for effecting the separating or stripping action. The blade may be of plastic material for providing certain support action for the ribbon. The wire arrangements may take the form of a preformed wire, as a leaf spring, the form of a wire material that assumes an arc or curve when the actuation force is reversed, or the form of a wire that takes advantage of the motion of the paper to aid in returning the wire to its arcuate position. In certain of the separating or stripping arrangements, the paper is usually moved upward a greater distance than the height of one print line in order to create blank space between print lines. The additional paper movement, after completion of the stripping action, can aid in repositioning of the wire.

Another arrangement may use a taut wire (non-moving) as the separating or stripping device. The taut wire is located just above the print head but in a position between the top of the horizontal ribbon and the paper. Since the ribbon and the paper are partially fused or bonded during the printing operation, there is a natural tendency for the ribbon to move with the paper until separated, either by pulling the ribbon away from the paper or by using a stripping or separating device. In the case of the taut wire arrangement the motion of the paper and ribbon causes the stripping action, as the printed line moves up, relative to the stationary taut wire stripping device.

A preferred arrangement of separating or stripping mechanism includes the use of a formed stripper blade which is attached to the print head carriage. A small formed metal blade is secured to the stripper blade and is designed to have a spring or like resilient characteristic to aid in separating or stripping the ribbon from the paper. The means for actuating the stripper blade includes a cam arrangement that is coupled with the print head carriage drive mechanism so as to have the actions synchronized during the printing operation.

In view of the above discussion, a principal object of the present invention is to provide means for allowing freedom of travel of the ribbon and the paper in thermal transfer printing operation.

Another object of the present invention is to provide means for separating the thermal transfer ribbon from the paper after the printing operation.

An additional object of the present invention is to provide a variety of ways and means for effecting separation of the ribbon from the paper after printing.

A further object of the present invention is to provide separating or stripping mechanism supported from the print head carriage and actuated from the print head drive mechanism for separating or stripping the ribbon from the paper after printing a line of characters in printing operation.

Additional advantages and features of the present invention will become apparent and fully understood from a reading of the following description taken together with the annexed drawing.

BRIEF DESCRIPTION OF THE DRAWING

FIG. 1 is a perspective view of a prior art printer showing an arrangement for separation of paper and a thermal transfer ribbon;

FIG. 2 is a plan view of a portion of a prior art printer including a ribbon, cassette and showing an arrangement of print head and ribbon movement;

FIGS. 9A and 9B are a perspective view and a side view of another arrangement for actuating a separating or stripping wire;

FIG. 14A shows another arrangement of means for actuating stripping mechanism;

FIG. 14B shows a profile of a cam for use in the mechanism of FIG. 14A;

FIG. 14C shows a detail of the ribbon stripping actuating member in FIG. 14A.

DESCRIPTION OF THE PREFERRED EMBODIMENT

Figure 3A:
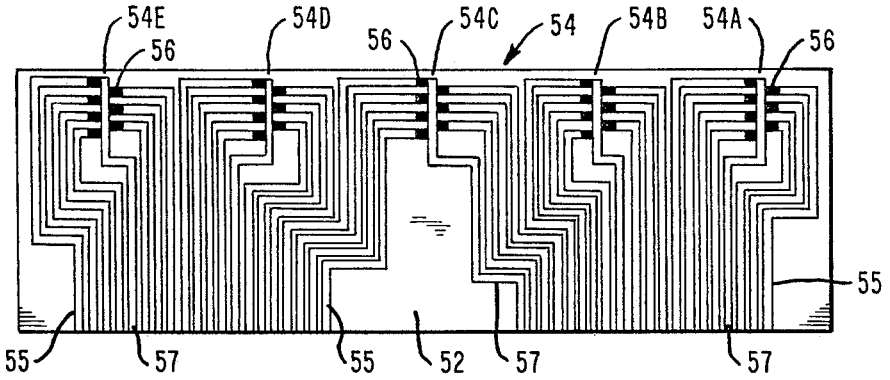
PRIOR ART FIG. 3A
FIGS. 3A and 3B are face views of types of thermal print heads showing banks of printing elements and wherein separation of the ribbon from the paper is an essential operation.

Referring now to FIG. 1, there is illustrated a printer, generally designated as 10, which includes a lower enclosure 12 providing a framework for certain parts of the printer. The essential parts of the printer 10 relevant to the subject matter of the present invention include a combination ribbon/paper supply roll 14 from which the ribbon 16 and the paper 18 are advanced in printing operations. A round platen 20 is caused to be rotated by means of a platen gear 22 which is suitably driven by a stepper motor 24. The platen gear 22 is meshed with a takeup gear 26 which rotates a takeup roller 28 for the ribbon 16. The platen 20 and the roller 28 are suitably journaled in side frames 27 and 29. Drive means 30 is provided beneath the takeup roller 28 for driving a print head carriage (not shown) which carries a thermal print head (also not shown) adjacent the platen 20. The drive means provides for side-to-side movement of the carriage and the print head in printing operation. During such printing operation, the print head is maintained in a position next to the ribbon 16 and the paper 18 for transferring ink material from the ribbon onto the paper in one direction of travel of the print head during the printing cycle, say from left to right. When the print head is returned in the right to left direction, the print head is moved away from the ribbon 16 to permit advancement of the ribbon and of the paper during the non-printing cycle of operation. It is during the non-printing cycle that the ribbon must be separated from contact with the paper to result in clear and precise printing thereon. In the illustration of FIG. 1, the ribbon 16 is advanced in the direction of the arrow 32 and the paper 18 is advanced in the direction of the arrow 34. While initially the ribbon 16 and the paper 18 are advanced in the same direction from the supply roll 14, the effect of such movement past the printing station as indicated by the arrows 32 and 34, causes separation of the ribbon 16 from the paper 18 and the ribbon is rewound onto roller 28 while the paper is provided as a receipt to the customer. In this arrangement, the ribbon 16 and paper 18 direction of movement and velocity are equal, so that the relative velocity between ribbon and paper is zero. The separation of the two elements occurs while the ribbon 16 is being pulled away from the paper 18 by the ribbon takeup roller 28.

FIG. 2 shows an arrangement wherein a ribbon 36 contained in a ribbon cassette 38 is driven in the direction of the arrows 48 past a printing station A print head 40 carried by a carriage 42 is positioned adjacent paper 44 trained around or past a platen 46. The ribbon cassette 38 is suitably supported from a printer frame (not shown) and the ribbon 38 and the print head 40 are driven by appropriate drive means (also not shown) for printing operation that is well known in the art. It is seen in the arrangement of FIG. 2. that the print head 40 and the carriage 42 are moved or driven in the left to right direction, as indicated by the arrow 50, whereas the ribbon 36 is moved or advanced in the right to left direction past the printing station. In this case, the ribbon velocity equals the velocity of the print head, but is opposite in direction, so that the relative velocity of ribbon to paper is zero. Separation of the ribbon 36 from the paper 44 occurs as the print head 40 moves from left to right and the ribbon is taken up from right to left.

FIG. 1 illustrates an arrangement in a relatively continuous printing operation wherein the ribbon and paper are separated in a ribbon stripping scheme by pulling the ribbon from the paper at a particular angle. In FIG. 2, the separation of the ribbon and paper is accomplished at a different angle between the two elements in the stripping scheme. In certain cases, the stripping angle between ribbon and paper is critical whereas in other cases both the stripping angle and the time between the actual printing operation and the stripping action are critical to the operation of the printer.

Figure 3B:
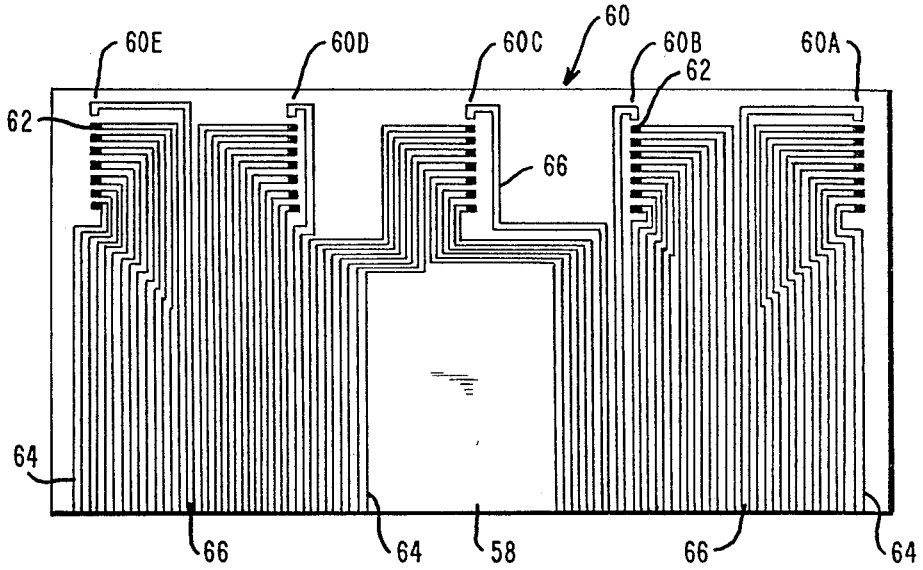
FIG. 3B PRIOR ART

FIGS. 3A and 3B are face views of two print heads of the types commonly used in thermal printing operation. The print head in FIG. 3A includes a substrate 52 which has five banks, overall indicated as 54, of print elements 56, with each bank 54A, 54B, 54C, 54D and 54E containing seven print elements. The printing speed with such an arrangement is increased by increasing the number of print elements 56 on the substrate 52 thereby increasing the speed by a factor of several times and still maintaining a relatively low cost print head. The five banks (54A–54E) of print elements 56 are arranged and fabricated on one substrate material, and for a thick film type thermal print head which predominantly uses silk screen processes for fabrication, the number of print elements can be increased, say to the 35 shown, without incurring substantial increases in print head cost. The thermal print elements 56 are connected by respective conductor runs 55 to connector pads (not shown). A common conductor 57 is provided to complete the circuitry for the print elements 56.

FIG. 3B is a different arrangement of a print head having a substrate 58 which has five banks, overall indicated as 60, of print elements 62, with each bank 60A, 60B, 60C, 60D and 60E containing seven print elements in aligned vertical manner. The vertical alignment of the seven print elements 62 provides for printing a seven high dot matrix character in each pass of the print head in the printing operation. The thermal print elements 62 are connected by respective conductor runs 64 to connector pads (not shown). A common conductor run 66 is provided to complete the circuitry for each print element 62.

In the case of a thermal transfer printer utilizing a thermal print head having a plurality of print elements disposed both horizontally and vertically on a substrate, as shown in FIG. 3A, stripping of the ribbon from the paper is possible only after printing one complete line of characters, rather than after printing each dot row or after printing several characters. In this case, the print head is shuttled or moved about one-half inch in the transverse direction, with each set of vertical print elements printing an integral number of characters to complete the print line. For example, each of the five banks of print elements prints eight characters, for a total of up to 40 characters in the print line. After printing, a complete stripping of the ribbon from the paper is required before the succeeding line can be printed. It is noted that the ribbon is horizontally oriented, as shown in FIG. 2 and also in FIGS. 10 and 11, while the paper is oriented and is displaced in the vertical direction. In order to print the subsequent line, the used ribbon must be taken up or indexed out of the printing position and new ribbon must be positioned over the next print line location.

FIGS. 4A–4D illustrate, in diagrammatic form, the successive steps in one arrangement of separating the ribbon from the paper in a thermal printer. The several figures show a platen 70, paper 72 positioned against the face of the platen, a ribbon 74 disposed against the paper, and a print head 76 positioned in printing and non-printing positions and supported from a carriage 78. A stripper blade 80 is positioned and interposed between the ribbon 74 and the paper 72 for separating the ribbon therefrom after the printing operation. The stripper blade 80 is made of stainless steel and has a beveled tip 82 for precise separation of the ribbon 74 from the paper 72. The stripper blade may be attached to the front of the ribbon cassette, as later described relative to FIG. 8B.

Figure 4A:
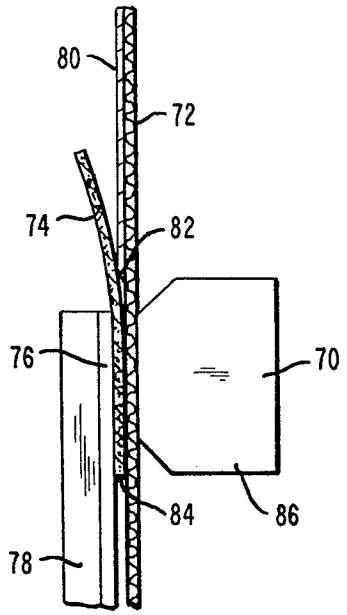
FIGS. 4A–4D show successive steps in one arrangement of ribbon separation which uses a beveled blade.
Figure 4B:
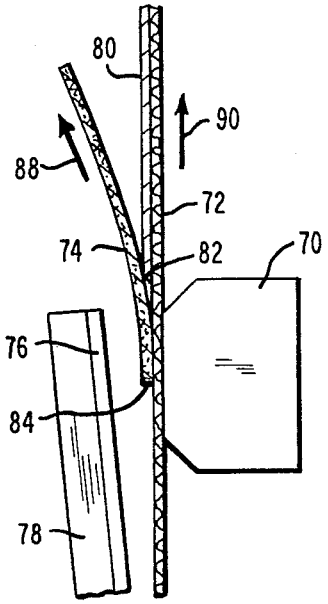
Figure 4C:
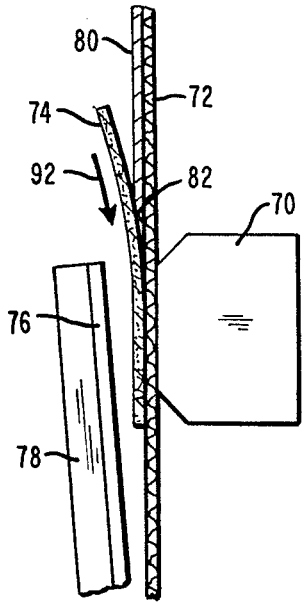
Figure 4D:
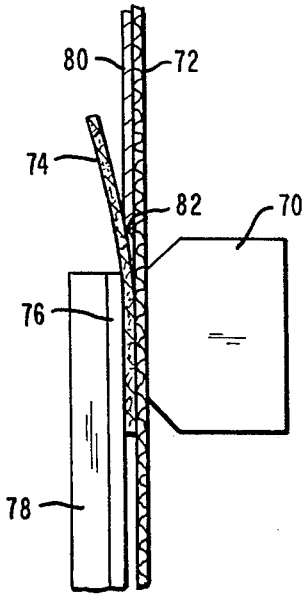

FIG. 4A shows the arrangement of the parts in the printing position wherein the platen gap is closed and wherein the lower edge 84 of the ribbon 74 is about level with the lower side 86 of the platen 70. FIG. 4B shows the parts in a non-printing position wherein the platen gap is open and the ribbon 74 and the paper 72 are being advanced upwardly in the direction of the arrows 88 and 90, and as clearly shown by the position of the lower edge 84 of the ribbon 74. During such upward movement, the ribbon 74 and the paper 72 encounter the beveled edge 82 of the stripper blade 80 which separates the ribbon from the paper. FIG. 4C shows the ribbon 74 moving downwardly in the direction of the arrow 92 and returning to the printing position as the ribbon is being indexed in a horizontal direction, as previously shown and described relative to FIG. 2. In this manner, the ribbon is moved and indexed so that new ribbon is in position for the next line of printing, as illustrated in FIG. 4D. It is seen that due to the relative position of the print elements, as 56 and 62 (FIGS. 3A and 3B), the stripper blade 80 must be positioned in proximity to the uppermost dots of each printed character, but not interfere with printing thereof. Therefore, the blade thickness must be held at a minimum, however consistent with the required stiffness and structural integrity.

Figure 5A:
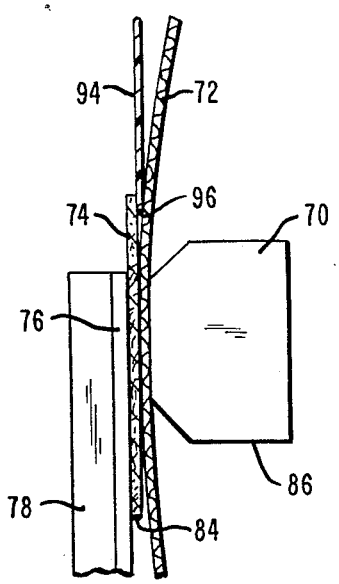
FIGS. 5A and 5B show two steps in an arrangement using a different type blade.
Figure 5B:
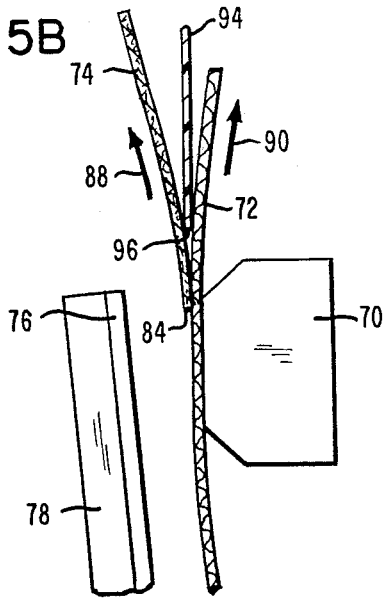

FIGS. 5A and 5B illustrate a similar arrangement of the various parts of the printer including the platen 70, the paper 72 positioned against the face of the platen, the ribbon 74 disposed against the paper, and the print head 76 positioned in printing and non-printing positions and supported from the carriage 78. A stripper blade 94 is positioned and interposed between the ribbon 74 and the paper 72 for separating the ribbon therefrom after the printing operation. The stripper blade 94 is made of Mylar material, Mylar being a trademark of du Pont.

FIG. 5A shows the arrangement of the parts in the printing position wherein the platen gap is closed and wherein the lower edge 84 of the ribbon 74 is below the lower side 86 of the platen 70. FIG. 5B shows the parts in the non-printing position wherein the platen gap is open and the ribbon 74 and the paper 72 are being advanced upwardly in the direction of the arrows 88 and 90, and as shown by the position of the lower edge 84 of the ribbon 74. During such upward movement, the ribbon 74 and the paper 72 encounter the edge 96 of the stripper blade 94 which separates the ribbon from the paper.

An advantage of the Mylar blade 94 is realized by reason of the inherent characteristics of the material to exhibit certain static electric properties which are created when the ribbon 74 and the paper 72 are moved relative to the blade 94. Since the thermal transfer ribbon 74 provides very little structural rigidity due to the material utilized and to the ribbon thickness (approximately 0.0005 inch), support of the ribbon in the vertical direction is advantageous in that ribbon buckling and curling are minimized. The static properties of the Mylar material of blade 94 serve to aid in the support of the ribbon 74 in its positioning past the printing station.

Figure 6A:
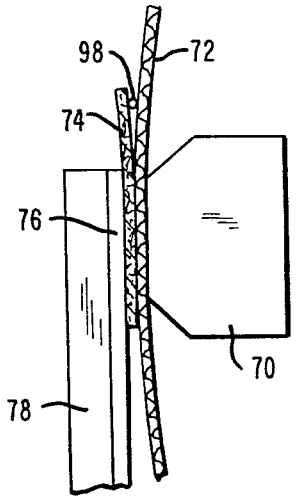
FIGS. 6A and 6B show the two steps in an arrangement using separation or stripping wire.
Figure 6B:
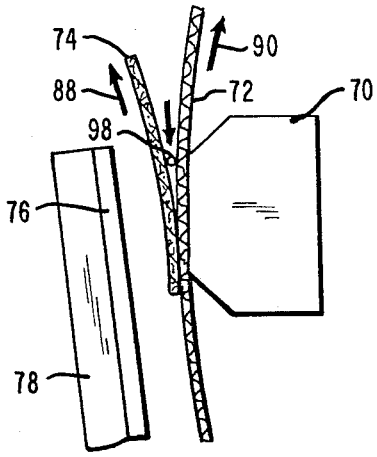

FIGS. 6A and 6B illustrate another similar arrangement of the various parts of the printer including the platen 70, the paper 72 positioned against the face of the platen, the ribbon 74 disposed against the paper, and the print head 76 positioned in printing and non-printing positions and supported by the carriage 78. In this embodiment, the ribbon stripping device is a wire 98 of a diameter of approximately 0.005 inch. The wire 98 may be secured at one end thereof to a side of the ribbon cassette or to a side frame of the printer and the other end may be connected to actuating mechanism, later described. The wire 98 forms an arc above the zone or area of printing during the printing cycle. After the printing cycle or during non-printing operations, the wire 98 is pulled taut by mechanical actuating mechanism to straighten the wire toward a horizontal position and to effect separation of the ribbon 74 from the paper 72. The action of the actuating mechanism, combined with the upward motion of the ribbon 74 and of the paper 72, in the direction of the arrows 88, 90, as the paper is indexed to the next position for a printing cycle, strips the ribbon 74 from the paper 72. After the stripping operation, the mechanical actuating mechanism releases the tension on the wire 98, thereby permitting it to return to the unstrained or arcuate position.

It is within the-scope of the present invention to us several wire configurations for effecting separating or stripping of the ribbon 74 from the paper 72. A first-arrangement uses a preformed or preset wire, similar in shape to a leaf spring, and wherein the wire returns to its unstrained position when not actuated or worked. A second arrangement may use a wire of an appropriate material that forms the arcuate shape when the actuation force is reversed to provide a stripping action similar to that accomplished in the first wire arrangement. A third arrangement, with the wire stripper, takes advantage of the motion of the paper (upward) to aid in returning the wire to its arcuate form and position. In the latter case, the paper is moved upwardly a greater distance than the height of one print line (generally about 28–30 percent greater) in order to create blank space between print lines, such additional paper movement, after stripping of the ribbon from the paper, being an aid in the repositioning of the wire to its arcuate form. Another possible arrangement can use a taut or non-moving wire as the stripping device wherein the wire is located just above the print head, but at a point between the top of the ribbon in its generally horizontal position and the paper. Since in practically all cases in the field of thermal transfer printing, the ribbon is fused to the paper during the printing cycle, there is a natural tendency for the ribbon to move with the paper until separated therefrom, either by pulling the ribbon from the paper or by interposing the stripping device therebetween. When a taut wire is used as the stripping device, the motion of the paper along with the ribbon accomplishes the stripping action as the printed line moves upward relative to the stationary wire.

Figure 7:
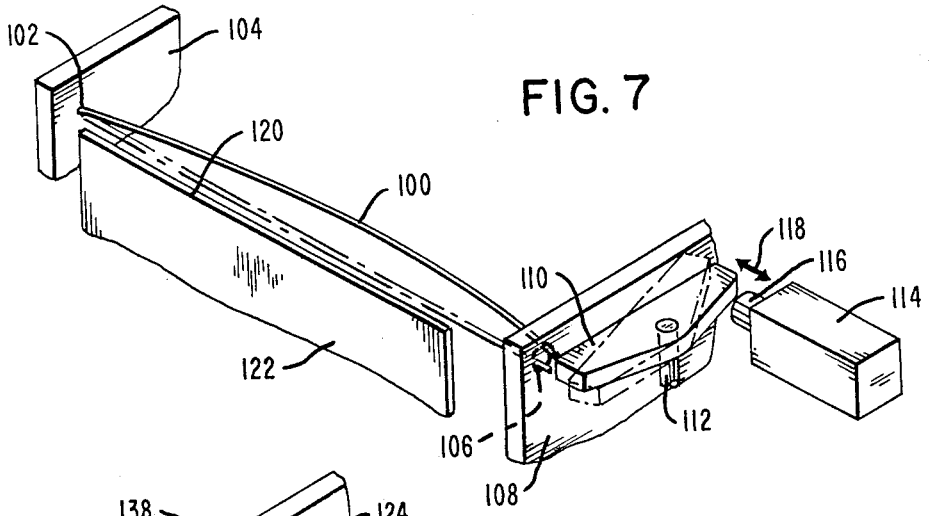
FIG. 7 is a perspective view of an arrangement for actuating a separating or stripping wire.

FIG. 7 shows mechanical actuating apparatus for causing a wire 100 to be moved in the manner of straightening thereof for stripping the ribbon from the paper. In this arrangement, the wire 100 is preformed and is attached at one end 102 to a left side frame 104 of the printer and extends through an opening 106 in a right side frame 108 and is connected to an actuating lever 110 pivoted on a pin 112. A solenoid 114 is actuated to move the plunger 116 thereof in the direction of the arrow 118 to cause pivoting or swinging of the lever 110 on the pin 112 and to move the lever 110 and the wire 100 to the respective phantom-line positions. In this manner, the preformed wire 100 is straightened into a tensioned condition to effect stripping of the ribbon from the paper in a simultaneous motion of wire and paper movement. It is seen that the wire 100 in a tensioned or taut condition is adjacent an upper edge 120 of a print head 122 and the wire is above the edge 120 when in an arcuate position which allows movement of the print head during the printing cycle.

Figure 8A:
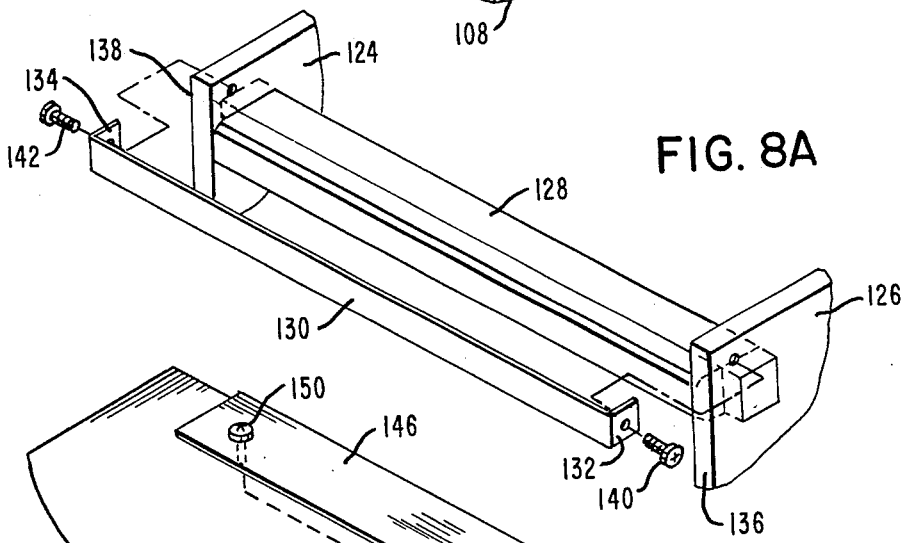
FIG. 8A is a perspective view of means for mounting a ribbon stripping member on the platen assembly or the frame of the printer.
Figure 8B:
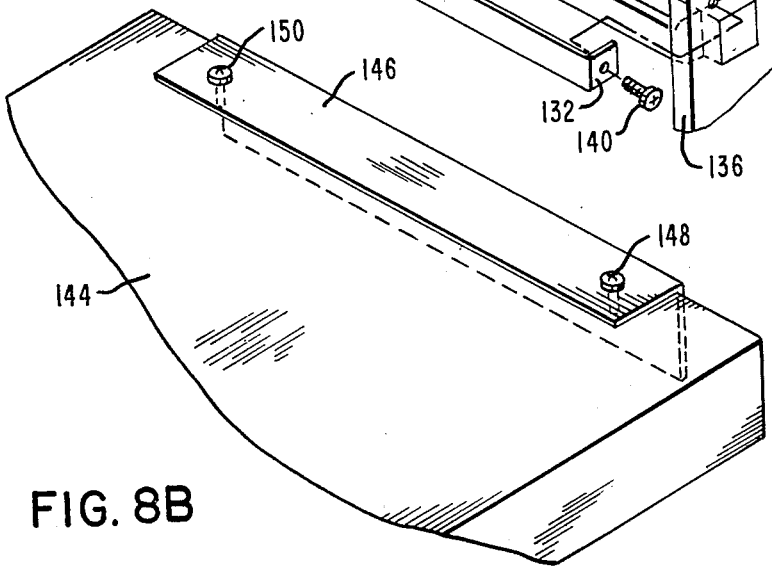
FIG. 8B is a similar view of means for mounting a ribbon stripping member on the ribbon cassette of the printer.

FIGS. 8A and 8B illustrate ways for mounting ribbon stripping members on parts of the printer. FIG. 8A shows a left side frame 124 and a right side frame 126 with a platen 128 positioned therebetween. A ribbon stripper 130 comprises an elongated strap-like member with angled ends 132 and 134 formed to fit around end portions 136 and 138 of the side frames 124 and 126 and to be attached to such frames by the screws 140 and 142. Depending upon the extent of the platen 128 relative to the side frames 124 and 126, the screws may be used with the platen to secure the stripper 130 thereto. FIG. 8B shows a ribbon cassette 144 with a ribbon stripper 146 in the form of an elongated angle secured to the cassette with screws 148 and 150. The arrangement shown in FIG. 8A is preferred by reasons of its inherent stability and by circumventing replacement of the stripping device 146 each time the ribbon cassette is replaced.

FIGS. 9A and 9B are a perspective view and a side elevational view, partly in section, of actuating apparatus for a stripping wire 152, the wire being secured at the ends thereof to a right hand swingable member 154 and a left hand swingable member 156. The members 154 and 156 are connected at respective ends 162 and 164 thereof by means of a rod 158 and are suitably supported on a pivot line 160. A solenoid 166 includes a plunger 168 which is coupled in suitable manner to one end 162 of the swingable member 154 and, upon actuation of such solenoid, causes swinging of the stripping mechanism.

FIG. 9B shows the platen 70, the paper 72 positioned against the platen, and the print head 76 positioned in non-printing position and supported by the carriage 78. The ribbon 74 and the paper 72 are shown moving in the direction of the arrows 88 and 90 while the member 156 is being swung in a counterclockwise direction, as indicated by the arrow 170, upon movement of the plunger 168 of solenoid 166 in the direction of the arrow 172. It is seen that this arrangement utilizes a taut wire implementation of the stripping mechanism wherein the wire support members 154 and 156 are actuated by the solenoid 166 as required after printing each line. The wire 152 is displaced in the direction opposite the direction of movement of the ribbon 74 and the paper 72 so that the combined actions occur simultaneously and effect stripping of the ribbon from the paper.

Figure 10:
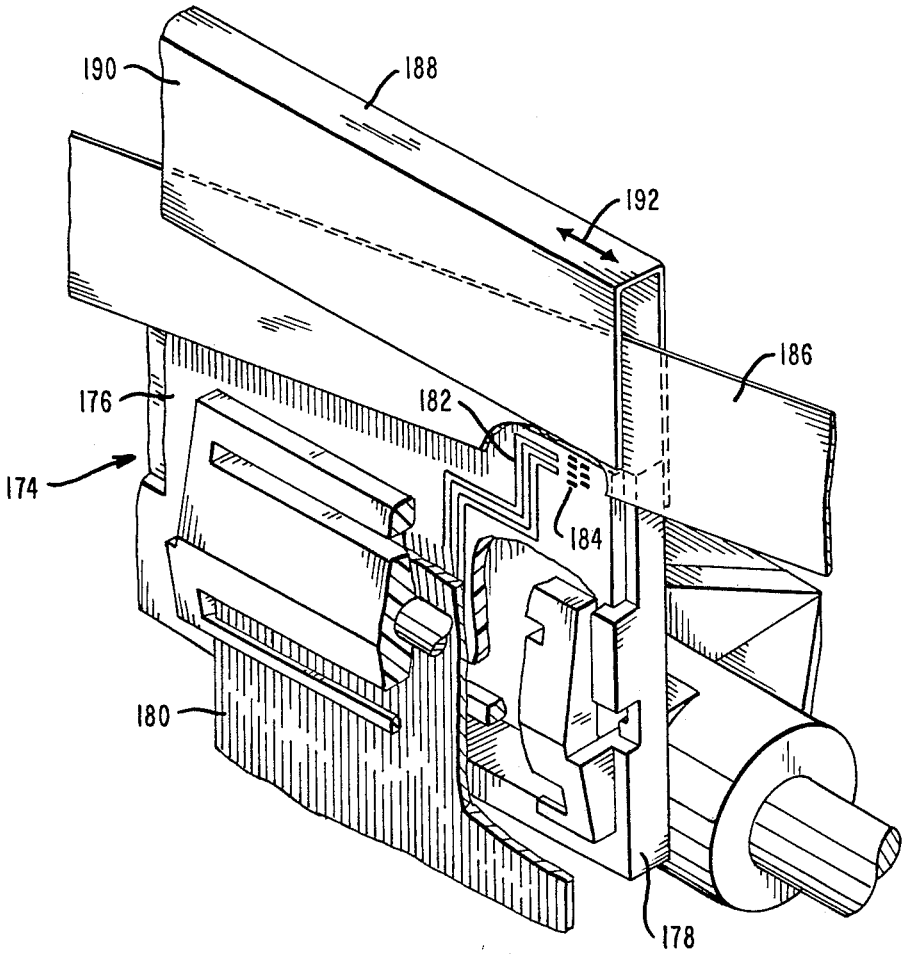
FIG. 10 is a perspective view of a portion of a printer in ribbon stripping mechanism.

FIG. 10 illustrates another arrangement of ribbon stripping mechanism associated with a portion of a printer 174 that includes a thermal print head 176 supported from and carried by a print head assembly 178. The print head assembly 178 carries and supports both the print head 176 and a flat ribbon-like cable 180 for supplying current and heat for thermal printing. The print head 176 includes a substrate which carries a plurality of conductor runs 182 connected to print elements 184. A thermal transfer ribbon 186 is directed in a path past the print head 176 and a ribbon stripping member 188 formed in the shape of an inverted U is suitably supported from and carried by the print head carriage assembly 178.

In this arrangement wherein the structural integrity of the ribbon must be maintained, the ribbon 186 is moved generally horizontal, albeit at an angle of about ten degrees, past the printing station and is indexed in a direction about ninety degrees displaced from the direction of paper movement. In this embodiment of the several elements shown in FIG. 10 and allowing for such ribbon angle of about ten degrees, the ribbon 186 is not indexed the full width of the print line after each printing operation, so that the used portion of the ribbon remains in proximity with the paper for several subsequent print lines after printing each line.

The disclosed stripping technique involves movement of the paper relative to the ribbon wherein during the stripping operation the paper is normally indexed one print line (9 dot rows or 0.135 inch). It has been found in the implementation of the ribbon stripping mechanism that due to the proximity of the stripper blade 190 to the print head 176, the paper indexing distance is not sufficient to produce a complete separation of the ribbon 186 from the paper. In operation and to ensure complete separation of the ribbon, the paper is over-indexed or moved vertically upward a distance equal to 18 dot rows and then retracted 9 dot rows downward while the ribbon 186 is being indexed generally in the horizontal direction. This arrangement ensures complete separation of ribbon from paper and represents a stripping method that is highly reliable. The operations of stripping and forward paper indexing occur simultaneously and the operations of ribbon indexing and paper retraction (reverse indexing) also occur simultaneously, all during the time available for returning the print head during the non-printing cycle.

In the arrangement of FIG. 10, a combination of the lateral motion of the stripping member 188 which is carried by the print head carriage 178 during the printing and the return cycles in the directions of the arrow 192, together with pivotal motion of the stripping member 188 and of the carriage 178 away from the paper during the return cycle of the print head carriage, and the vertical motion of the paper, effect separation of the ribbon from the paper. Therefore, the stripping action begins as the print head pressure is being released and continues as the blade 190 moves from right to left (return cycle) and as the paper is advanced or indexed upward. In FIG. 10, of course, it is seen that there may be some difficulty or complication when loading and threading the ribbon 186 in the printer.

Figure 11:
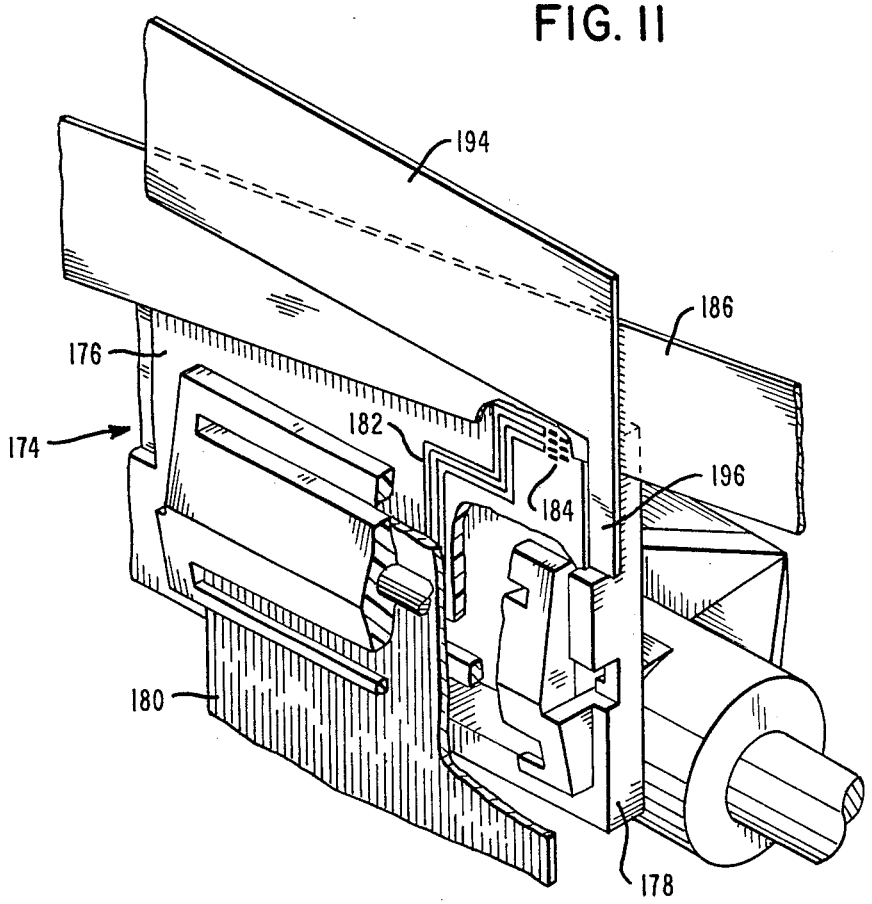
FIG. 11 is a perspective view of a portion of a printer incorporating another type of ribbon stripping mechanism.

FIG. 11 illustrates a variation or modification of the FIG. 10 arrangement wherein a portion of the printer 174 includes the print head 176 supported from and carried by the print head carriage assembly 178. The assembly 178 carries and supports both the print head 176 and the ribbon cable 180, the print head including the conductor runs 182 connected to the print elements 184. The ribbon 186 is directed in an angled path past the print head 176 and a ribbon stripping member 194 is suitably supported from and carried by the carriage 178. The stripping member 194 includes a support arm 196 at each end thereof (only one shown) for attaching to the carriage 178, and such member is formed in the shape of an inverted U in one plane, substantially parallel to the plane of the print head 176. The stripping operation is essentially the same as that described for FIG. 10.

Figure 12A:
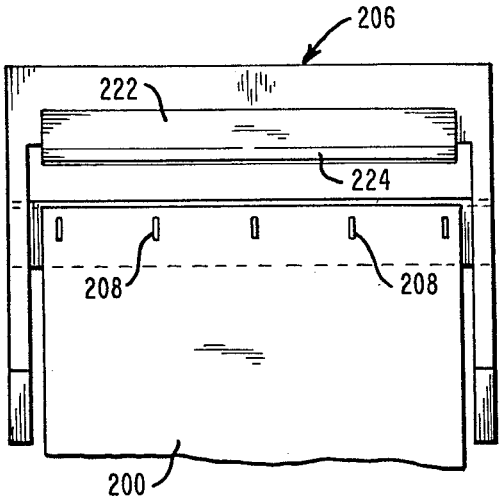
FIG. 12A is a diagrammatic view of a ribbon stripper blade associated with a print head as generally configured and as shown in FIG. 3B.
Figure 12B:
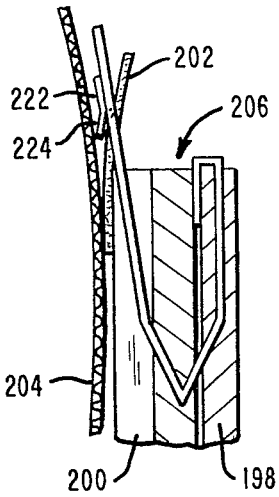
FIG. 12B is a side view of a portion of a printer showing a preferred arrangement of the ribbon stripping mechanism.
Figure 13A:
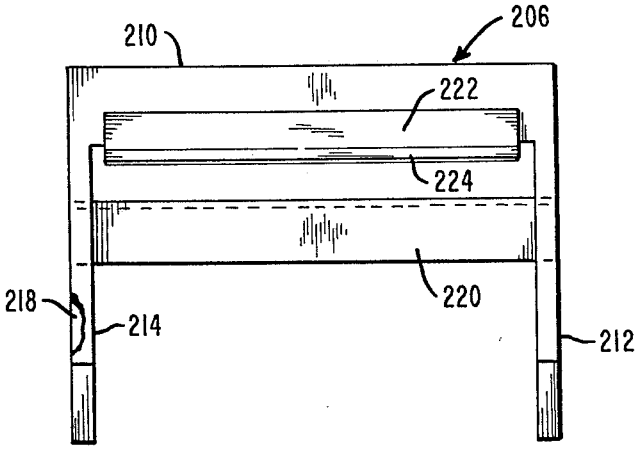
FIGS. 13A and 13B show front and side elevational views of a preferred ribbon stripping member.
Figure 13B:
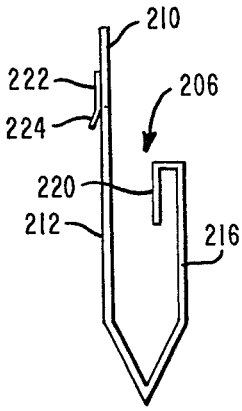

FIGS. 12A and 12B show another arrangement of ribbon stripping mechanism supported by a carriage 198 that carries a print head 200 adjacent a ribbon 202 and paper 204. The stripping mechanism 206 is generally V-shaped and shown in more detail in FIGS. 13A and 13B. FIG. 12A shows the print head 200 with five banks 208 of print elements as arranged and shown in detail in FIG. 3B. The stripping mechanism 206 comprises a top elongated portion 210 and right and left downwardly extending frontal side portions 212 and 214 and formed as a V-shaped configuration with right and left upwardly extending rearward side portions 216 and 218. The side portions 216 and 218 are connected by a lip 220 extending therebetween which is structured in a turned over manner for support of the stripping mechanism 206 on the print head carriage 198. The stripping mechanism 206 includes a stripping element 222 which assumes the shape of an elongated blade having a lower angled portion 224 and attached, as by bonding, to the top portion 210 of the stripping mechanism.

The design and shape of the stripping mechanism 206 permits spring loading the stripping blade 222 so that when the carriage 198 with the print head 200 pivots to open the platen gap or to release the pressure of the print head from the paper, in an arrangement similar to the pivoting motion explained for FIGS. 10 and 11, the blade 222 separates the paper 204 by pushing the paper away from the ribbon 202. The V-shaped member 206 is made of 0.012 inch thick stainless steel and the blade 222 is made of 0.002 inch thick stainless steel. The blade 222 effects the initial separation of the ribbon 202 from the paper 204 and the member 206 provides the strength and rigidity for completing the separation.

FIGS. 14A, 14B and 14C illustrate another arrangement of ribbon stripping or separating mechanism including a stainless steel inverted U-shaped member 226 having a top blade portion 228 and right and left leg portions 230 and 232. A print head 234 is suitably driven in the directions of the arrow 236 an amount shown by the phantom line 238 for printing along the print line 240. A ribbon 242 is disposed at an angle to the print line 240 and driven therepast in indexing manner, and paper 244 is suitably indexed in a direction normal to the print line 240. The member 226 is guided by frame elements 246 and 248 on the right side and elements 250 and 252 on the left side to be moved in a vertical direction as indicated by arrow 254.

A lower rectangular member 256 has angled slots 258 and 260 disposed near the ends thereof for receiving pins 262 and 264 attached as a part of legs 230 and 232, respectively, and operably sliding along the slots as the member 256 is moved in a side-to-side direction. The member 256 is caused to be moved in such direction by means of camming mechanism comprising a cam member 266 (FIG. 14B) having a groove 268 formed therein for receiving a cam follower in the form of a pin 270 attached to the member 256. The cam member 266 is rotated by suitable means through a shaft 272. While only one groove 268 is shown in the cam member 266, a second groove (not shown) may be included for the purpose of driving the print head 234 in the side-to-side direction. The grooves 258 and 260 are cut at 45 degrees so as to provide a vertical displacement of the member 226 equal to the horizontal displacement of the actuating member 256. If a time of 40 milliseconds is permitted for the ribbon stripping operation, the stripping velocity will be 7.5 inches per second. A vertical displacement of 0.3 inch is preferred to ensure complete stripping of the ribbon 242 from the paper 244 after each line of printed characters.

In the arrangement wherein the cam member 266 includes the groove 268 and also includes another groove (not shown) for driving the print head 234, the action of the print head and of the ribbon stripper are "locked" together. During the printing cycle of the operation (carriage moving left to right) the follower 270 follows a constant radius portion 274 of the groove 268 and there is no displacement of the stripper member 226. During the return cycle of the operation, the pin 270 is guided into the reduced radius portion 276 of the groove 268 and the actuating member 256 is moved to the right, as indicated by the arrow 278, which causes the pins 262 and 264 to move along the slots 258 and 260 and to displace the stripping member 226 downward to separate the ribbon 242 from the paper 244.

Figure 15A:
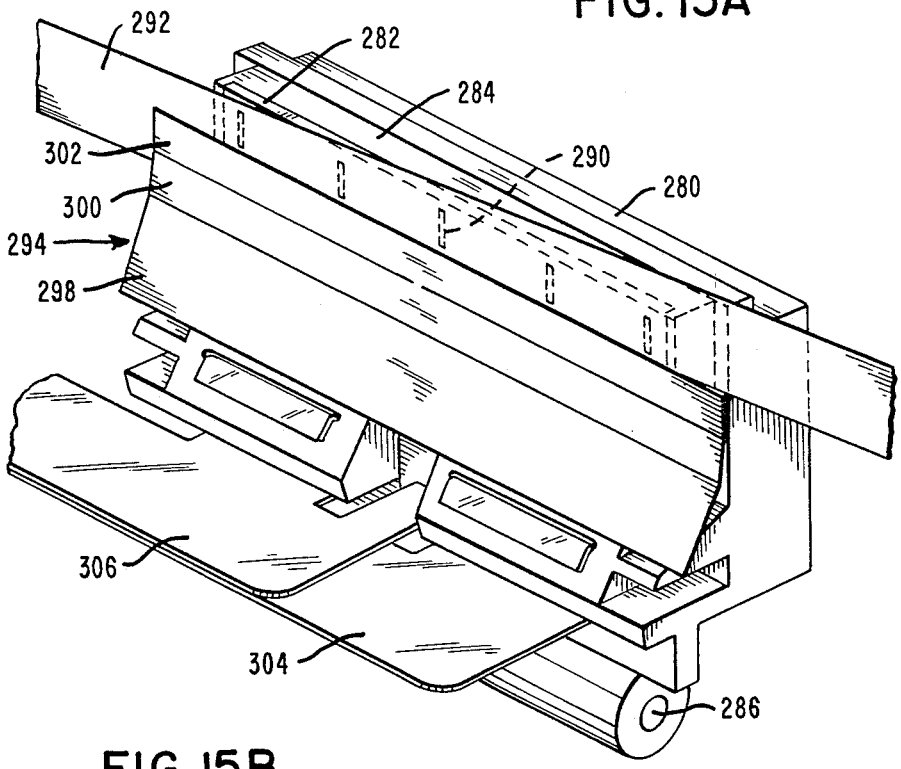
FIGS. 15A and 15B show a perspective view and a side elevational view of another arrangement of the ribbon separating mechanism.
Figure 15B:
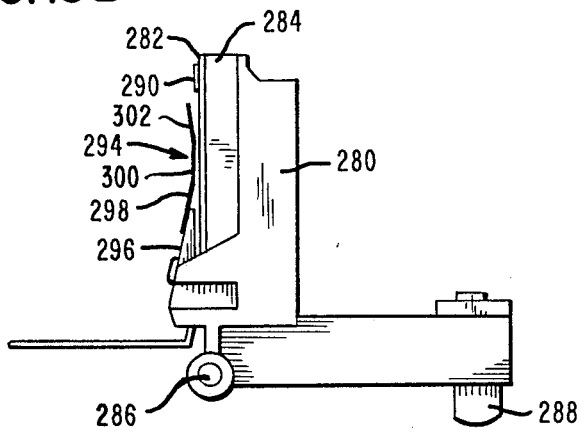

FIGS. 15A and 15B show another arrangement of a portion of a thermal printer with ribbon stripping mechanism wherein a print head carriage 280 supports and carries a print head 282 and an associated heat sink 284, and such carriage 280 is caused to be moved along a carriage shaft 286 by means of a follower 288 operating in a camming groove (not shown). The print head 282 is moved along a print line for printing by print elements, as 290, and a ribbon 292 is disposed adjacent the print elements at an angle to the line of printing to make use of a greater area of the ribbon. A stripping blade 294 made of 0.005 inch thick copper is attached to a portion 296 of the carriage 280, the blade extending substantially the width of the carriage 280 and formed to provide three portions. The lower rectangular portion 298 is fixed to the carriage portion 296, the middle portion 300 extends generally vertical, and the upper portion 302 is directed at an angle from the print head 282. The portions 300 and 302 of the stripping blade 294 are effectively spring loaded so as to provide space for the ribbon 292 between the blade and the print head 282. A pair of ribbon cables 3.04 and 306 provide current to the print head 282.

It is thus seen that herein shown and described is mechanism or apparatus for stripping or separating a thermal transfer ribbon from the paper in thermal printing operations wherein the stripping or separating mechanism includes blades of various configurations or wires formed in a number of ways to perform the stripping or separating operation. The blades or wires are positioned between the paper and the ribbon and engage the facing surfaces thereof and effect stripping of the ribbon from the paper when the blades or wires are actuated by actuating means. The arrangement enables the accomplishment of the objects and advantages mentioned above, and while a preferred embodiment and several modifications thereof have been disclosed herein, other variations may occur to those skilled in the art. It is contemplated that all such variations and several modifications not departing from the spirit and scope of the invention hereof are to be construed in accordance with the following claims.

We claim:

1. Apparatus for separating a thermal transfer medium from a record medium subsequent to a printing operation in a thermal printer, said apparatus comprising stripping means, means supporting said stripping means from said printer in a first position between and engageable with the facing surfaces of the transfer medium and the record medium, and means for actuating said stripping means from said first position to a second position wherein the stripping means is in contact with the facing surfaces of said transfer medium and said record medium for separating said transfer medium from said record medium upon advancement of said record medium.

2. The apparatus of claim 1 wherein the transfer medium is a thermal transfer ribbon.

3. The apparatus of claim 1 wherein said stripping means comprises a wire positioned adjacent the line of printing of said thermal printer.

4. The apparatus of claim 1 wherein said stripping means comprises a preformed wire positioned adjacent the line of printing and adapted to be straightened upon operation of said actuating means.

5. The apparatus of claim 1 wherein the actuating means comprises a swingable member and means for swinging thereof.

6. The apparatus of claim I wherein the means for supporting said stripping means is a member swingable in a generally vertical direction.

7. The apparatus of claim 1 wherein the means for supporting said stripping means is a member swingable in a generally vertical direction.

8. The apparatus of claim 1 wherein said actuating means comprises a solenoid.

9. The apparatus of claim 1 wherein said printer includes a print head carriage supporting said stripping means and carried by said carriage along the line of printing, and means for actuating said stripping means in a direction opposite that of the advancement of the record medium.

10. The apparatus of claim 9 wherein the actuating means comprises an actuating member defining slots at an angle therein and operably associated with the stripping means and cam means for driving said actuating member.

11. In a thermal printer having a print head operably associated with a transfer medium for transferring images onto a record medium in printing operation, the improvement comprising means for separating the transfer medium from the record medium subsequent to a printing operation, said separating means comprising a stripping member supported in a first position adjacent the transfer medium and the record medium during a printing operation and means for actuating the stripping member from said first position to a second position in contact with the facing surfaces of said record medium and said transfer medium for separating said transfer medium from the record medium.

12. In the thermal printer of claim 11 wherein the stripping member comprises a wire positioned adjacent the line of printing.

13. In the thermal printer of claim 11 wherein the stripping member comprises a preformed wire positioned adjacent the line of printing and adapted to be straightened upon operation of said actuating means.

14. In the thermal printer of claim 11 wherein the separating means comprises a stripping member and supporting means therefor swingable in a generally horizontal direction.

15. In the thermal printer of claim 11 wherein the separating means comprises a stripping member and supporting means therefor swingable in a generally vertical direction.

16. In the thermal printer of claim 11 wherein the actuating means comprises a solenoid.

17. In the thermal printer of claim 11 including a print head carriage supporting said stripping member and carried by said carriage along the line of printing and said means for actuating means said stripping member in a direction opposite that of the advancement of the record medium.

18. Apparatus for separating a thermal transfer ribbon from a record medium subsequent to a printing operation in a thermal printer having a print head carriage, a platen and a print head opposed thereto, said apparatus comprising a stripping member supported from said printer and secured to said print head carriage and positioned between and engageable with the facing surfaces of the transfer ribbon and the record medium in printing operation and in contact with the facing surfaces of said transfer ribbon and said record medium for separating said transfer ribbon from said record medium upon advancement of said record medium past said platen.

19. The apparatus of claim 18 wherein the stripping member comprises a blade defining an angle relative to the plane of the blade.

20. The apparatus of claim 18 wherein said stripping member comprises a generally V-shaped member substantially spanning the line of printing of said thermal printer.

21. The apparatus of claim 18 wherein said stripping member comprises a generally V-shaped member substantially spanning the line of printing and including stripping element secured to one portion of the V-shaped member.

22. The apparatus of claim 18 wherein the stripping member comprises an elongated blade secured to the print head carriage and movable therewith in a transverse direction.

23. The apparatus of claim 18 wherein the stripping member comprises a blade defining a bevel along one edge thereof.

24. The apparatus of claim 18 wherein said striping member comprises a U-shaped member secured to the carriage and movable therewith in a transverse direction.

25. The apparatus of claim 22 wherein said elongated blade includes an angled portion for accommodating said transfer ribbon.

* * * * *

UNITED STATES PATENT AND TRADEMARK OFFICE

CERTIFICATE OF CORRECTION

PATENT NO. : 4,806,948

DATED : February 21, 1989

INVENTOR(S) : Richard G. Bangs et al.

It is certified that error appears in the above-identified patent and that said Letters Patent is hereby corrected as shown below:

Column 13, line 8, "means" (second occurrence) should be --moves--.

Column 14, line 10, after the word "including" insert the word --a--.

Column 14, line 20, "striping" should be --stripping--.

Signed and Sealed this

Seventh Day of November, 1989

*Attest:*

JEFFREY M. SAMUELS

*Attesting Officer*

*Acting Commissioner of Patents and Trademarks*